United States Patent [19]

Pierce et al.

[11] Patent Number: 4,966,563

[45] Date of Patent: Oct. 30, 1990

[54] BUS BAR TAB CONNECTOR

[75] Inventors: Michael L. Pierce, Scottsdale; Scott J. Raffles, Chandler, both of Ariz.

[73] Assignee: Rogers Corporation, Rogers, Conn.

[21] Appl. No.: 336,762

[22] Filed: Apr. 11, 1989

[51] Int. Cl.[5] ..... H01R 4/48

[52] U.S. Cl. ..... 439/729; 439/790; 439/864

[58] Field of Search ..... 439/197, 260, 329, 593, 439/632, 708, 725, 729, 790, 792, 794, 795, 793, 864

[56] References Cited

U.S. PATENT DOCUMENTS

| | | | |
|---|---|---|---|
| 2,097,324 | 10/1937 | Hill | 439/794 X |
| 2,218,016 | 10/1940 | Anderson | 439/794 |
| 2,574,781 | 11/1951 | Greene et al. | 439/793 X |
| 3,076,166 | 1/1963 | Raodin | 439/197 |
| 3,579,283 | 5/1971 | Welburn | 439/729 X |
| 3,845,457 | 10/1974 | Reimer | 439/864 X |
| 4,003,619 | 1/1977 | Smith | 439/593 X |
| 4,884,976 | 12/1989 | Frank, Jr. | 439/92 |

FOREIGN PATENT DOCUMENTS

| | | | |
|---|---|---|---|
| 1292351 | 3/1962 | France | 439/793 |

*Primary Examiner*—Neil Abrams
*Assistant Examiner*—Khiem Nguyen
*Attorney, Agent, or Firm*—Fishman, Dionne and Cantor

[57] ABSTRACT

A bus bar tab connector which electrically and mechanically connects an electrically conductive tab extending from a bus bar to an electrically conductive tab from an external source is presented. In accordance with the present invention, the conductive tabs are slidably received into the bus bar connector and held together by either a spring force or a cammed shaft. The tabs are both easily connected and separated by the connector, requiring no special tools for connecting or separation. The bus bar connector of the present invention does not cause a decrease in current carrying capacity.

6 Claims, 8 Drawing Sheets

BUS BAR TAB CONNECTOR

BACKGROUND OF THE INVENTION

The present invention relates to the field of bus bars, power supply blades and back plane blades. More particularly, the present invention relates to a bus bar tab connector that attaches to a bus bar tab and allows a mating tab to connect to the bus bar tab.

Bus bars are used in the field of electronics as a device for distributing power and/or signals to appropriate locations in a system. Typically, a bus bar comprises two or more metal conductors, separated by an insulative strip. Each bus bar conductor includes a plurality of tabs extending therefrom at selected spaced locations. These tabs mate with other tabs in the system to deliver power to various components.

Often, it is necessary to mate a bus bar tab with another tab from a different device. Presently, such bus bar connections are made using nuts and bolts, studs or fast on tabs. Unfortunately, these connecting methods are costly. In addition, they increase assembly time by requiring tools for implementation and are difficult to change when worn out.

These prior art bus bar tab connecting methods also reduce the overall current carrying capacity of the bus bar. This results because of the requirement for holes to make the connections, which results in decreased current carrying capacity.

SUMMARY OF THE INVENTION

The above discussed and other problems of the prior art are overcome or alleviated by the bus bar tab connector of the present invention. In accordance with the present invention, a novel bus bar tab connector is provided which, when compared to the prior art, is more reliable, has a higher current capacity, and offers a lower cost method of connecting high power flat surfaces.

In a first embodiment, the bus bar tab connector of the present invention comprises an annular housing having opposed open ends, a pair of protrusions in the housing to hold the connector onto a bus bar tab, and a spring element which applies force to the tabs and allows the surfaces to electrically connect without the spring element passing current.

In a second embodiment of the present invention, the connector utilizes a cam to apply pressure between the tabs. Turning the cam 180° allows for easy insertion of the tabs. Subsequent turning of the cam locks the previously inserted tabs together.

It will be appreciated that the present invention precludes the use of mechanical fastening devices currently practiced in the art, thereby improving overall bus bar efficiency. It will be further appreciated that the present invention will easily connect a bus bar to external sources resulting in reduced manufacturing costs.

The above discussed and other features and advantages of the present invention will be apparent to and understood by those skilled in the art from the following detailed description and drawings.

BRIEF DESCRIPTION OF THE DRAWINGS

Referring now to the drawings, wherein like elements are numbered alike in the several FIGURES.

Figure 1:
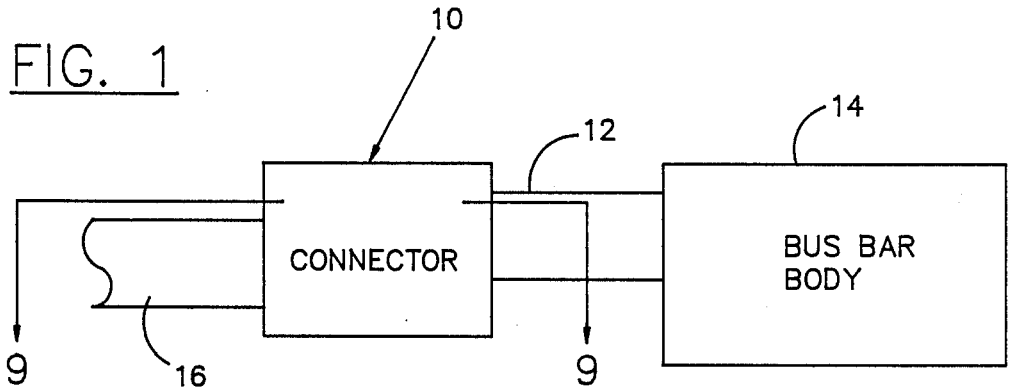
FIG. 1 is a side elevation view of a bus bar connector in accordance with the present invention connecting a bus bar tab to a mating tab.
Figure 2:
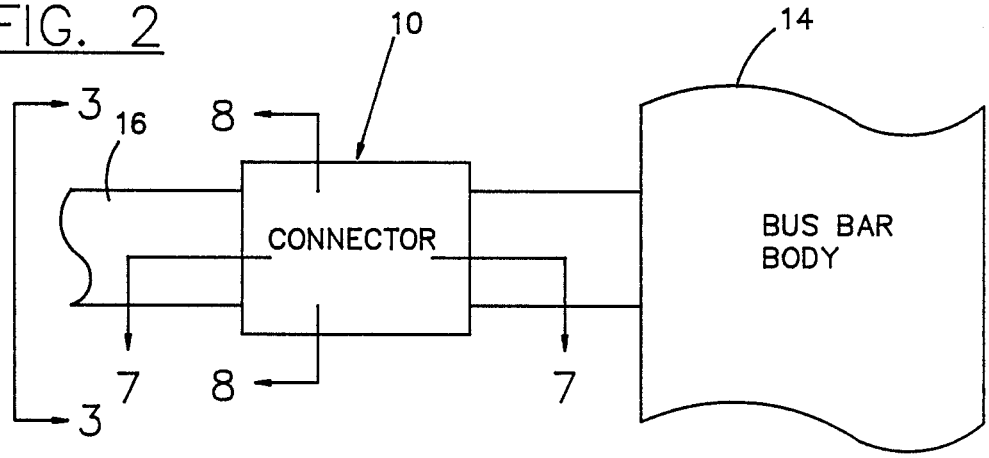
FIG. 2 is a bottom plan view of the assembly of FIG. 1.
Figure 3:
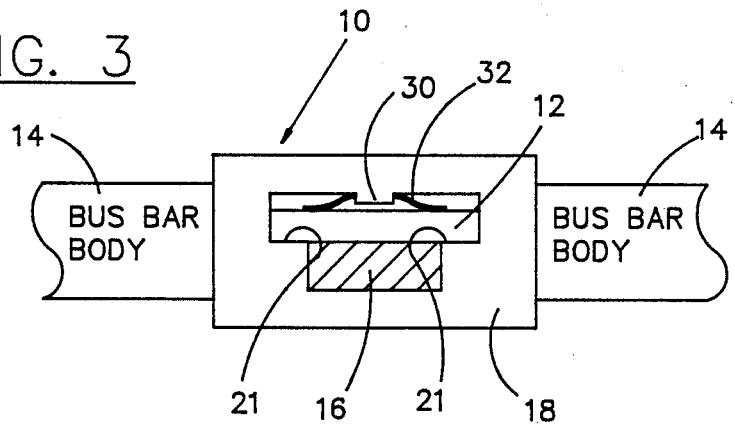
FIG. 3 is an end view of the assembly of FIG. 1 viewed along the 3—3 of FIG. 2.

DESCRIPTION OF THE PREFERRED EMBODIMENT:

Referring jointly to FIGS. 1–3, in accordance with the present invention, a bus bar tab connector identified generally at 10 and is utilized to connect a conductive tab 12 extending from a bus bar body 14 to another mating tab 16. It will be appreciated that bus bar 14 has a well known configuration comprising an elongated body made up of parallel conductors separated by insulative material. At preselected locations along the bus bar body, one or more conductive tabs 12 extend therefrom for connection to another electronic device.

There is often a need to connect a conductive tab 12 which extends from a bus bar body 14 to another conductive tab such as shown at 16. The conductive tab connector 10 in accordance with the the present invention accomplishes this kind of connection.

Figure 4:
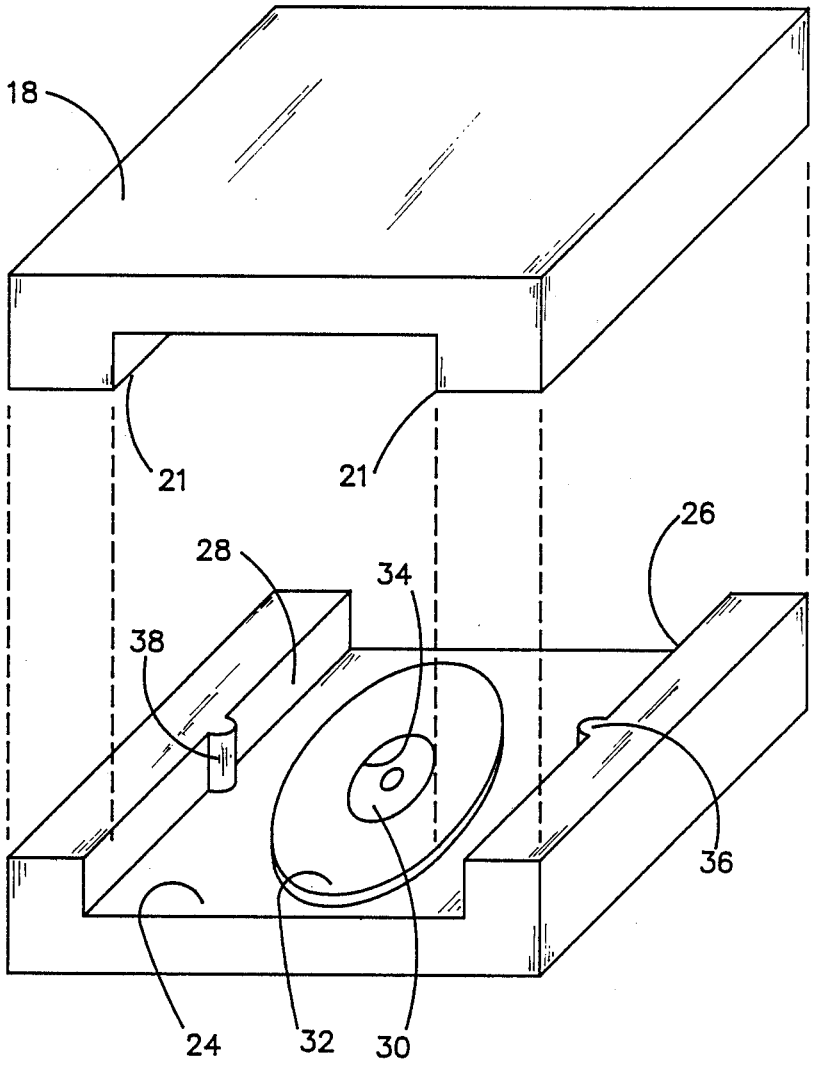
FIG. 4 is an exploded perspective view of a bus bar tab connector in accordance with the present invention.
Figure 5:
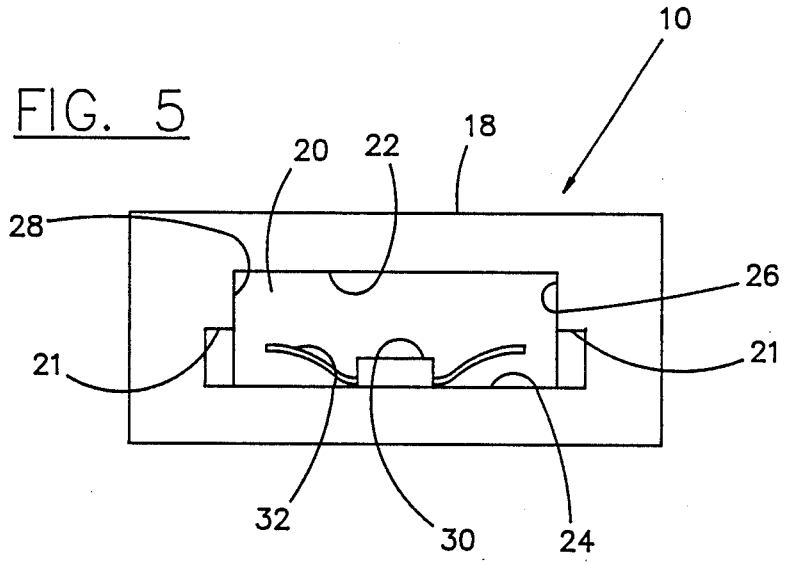
FIG. 5 is an end view of the bus bar tab connector of FIG. 4 subsequent to assembly.
Figure 6:
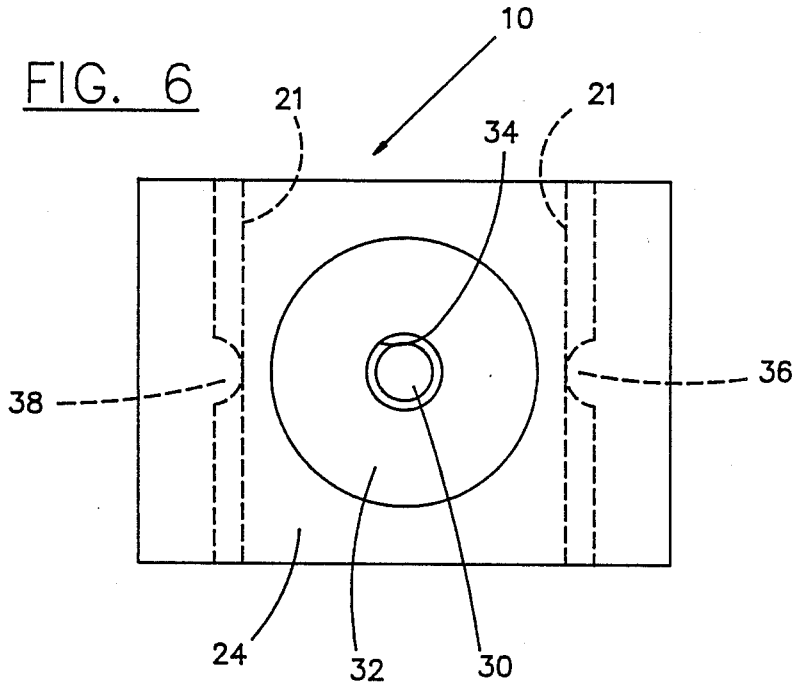
FIG. 6 is a plan view of the bus bar tab connector of FIG. 4.
Figure 7:
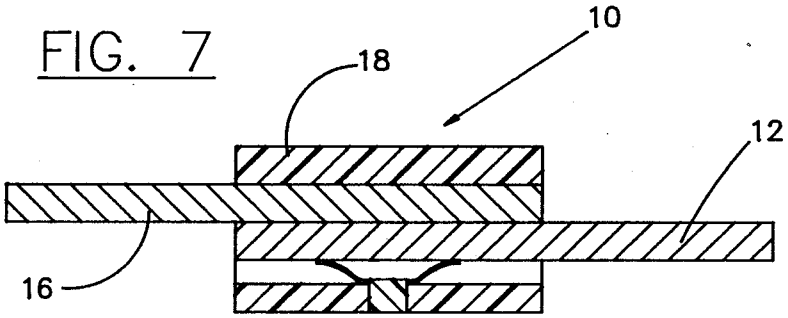
FIG. 7 is a cross sectional elevation view along the line 7—7 of FIG. 2.
Figure 8:
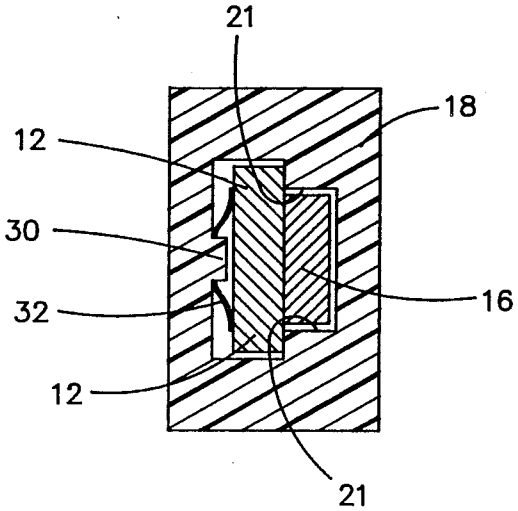
FIG. 8 is a cross sectional elevation view along the line 8—8 of FIG. 2.
Figure 9:
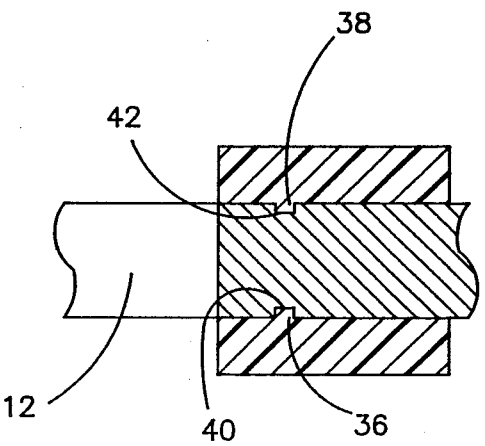
FIG. 9 is a cross sectional elevation view along the line 9—9 of FIG. 1.
Figure 10:
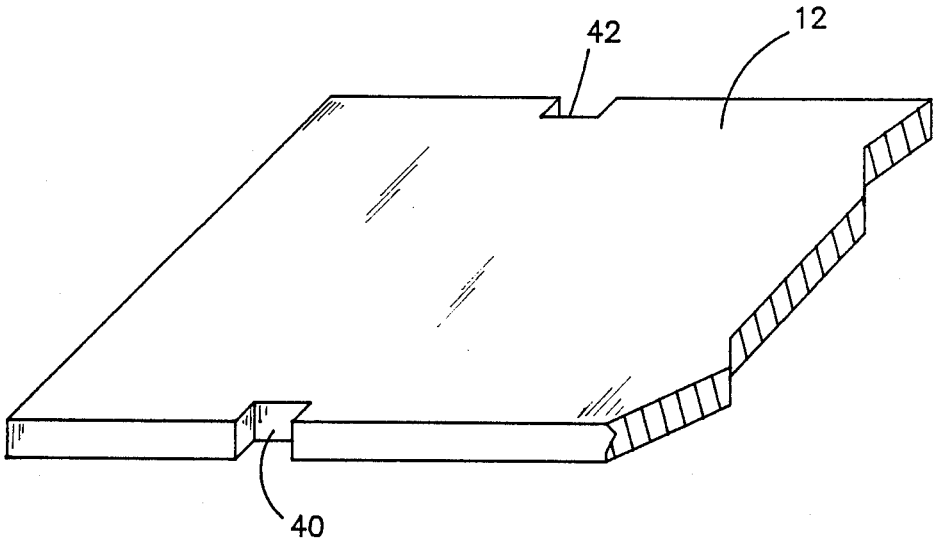
FIG. 10 is a perspective view of a portion of a bus bar tab for use with the connector of the present invention.
Figure 11:
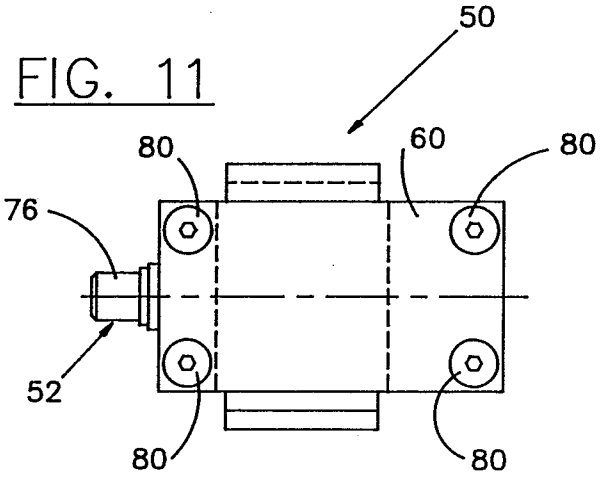
FIG. 11 is a top elevation view of a second embodiment of a bus bar tab connector of FIG. 11.
Figure 12:
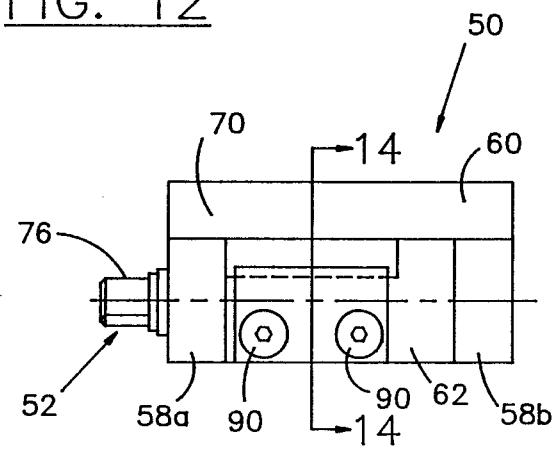
FIG. 12 is a side elevation view of the bus bar connector of FIG. 11.
Figure 13:
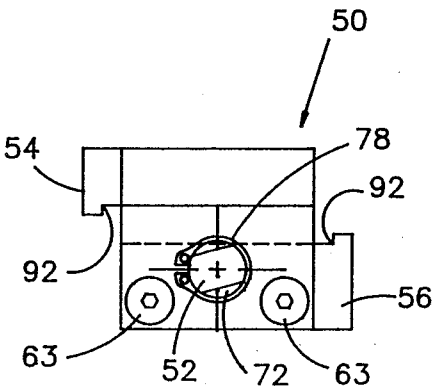
FIG. 13 is a front elevation view of a bus bar connector of FIG. 11.
Figure 14:
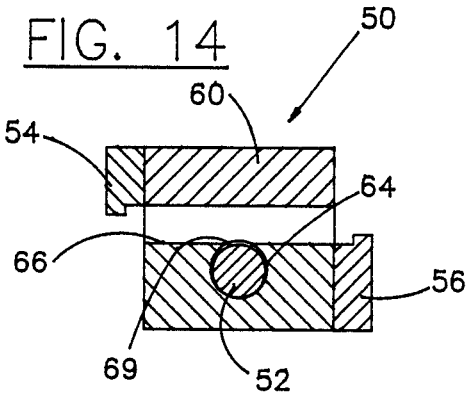
FIG. 14 is a cross sectional elevation view along the line 14—14 of FIG. 12.
Figure 15:
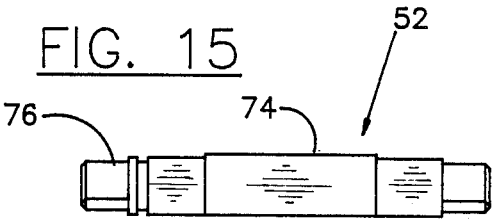
FIG. 15 is a side elevation view of a cam used in the bus bar tab connector of FIG. 11.
Figure 16:
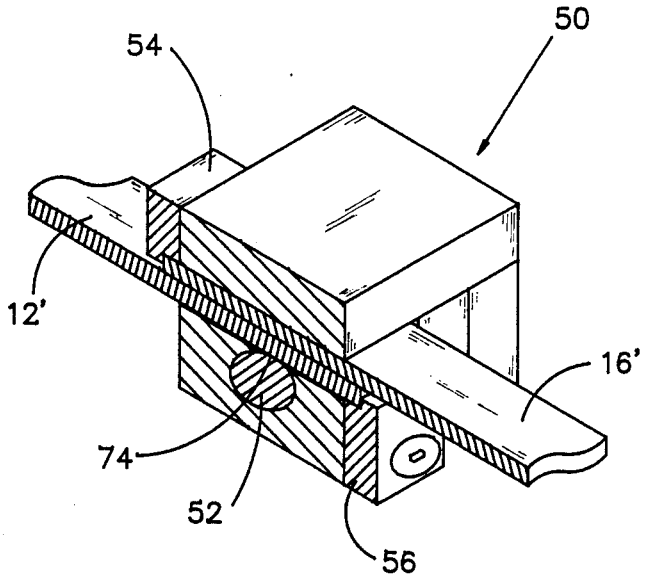
FIG. 16 is a perspective view, partly in cross section, of the bus bar tab connector of FIG. 11 with the connecting tabs being inserted therein.

Turning now to FIGS. 4–10, in accordance with a first embodiment of the present invention, bus bar tab connector 10 comprises a housing 18 which preferably has an overall rectangular configuration with a central rectangular opening 20. In a preferred embodiment, housing 18 is molded in one-piece from a suitable electrically insulated polymeric material. However, housing 18 may also be molded as two or more pieces such as shown in FIG. 4. Interior opening 20 of housing 18 includes a top surface 22, a bottom surface 24 and a pair of opposed side surfaces 26 and 28. Interior opening 20 of housing 18 also preferably includes a pair of opposed longitudinal shoulders 21 along each side surface 26 and 28 so that opening 20 has a first width for receiving tab 12 and a second, smaller width for receiving mating tab 16. Centrally located on bottom surface 24 is a locating dowel 30 which extends upwardly a short distance from bottom 24. A suitable compression or spring element 32 (which in a preferred embodiment comprises a well known conical spring element commonly referred to as a Belleville washer) includes a central opening 34 which is sized to be received on main dowel 30 as shown in the FIGURES. When spring element 32 comprises a Belleville washer, it will be appreciated that the washer is positioned such that its diverging section faces the upper face 22 of housing 18. Each sidewall 26 and 28 in opening 20 includes a rounded protrusion 36 and 28, respectively. Protrustions 36 and 38 are intended to mate and retain corresponding notches 40 and 42 (see FIG. 10) in bus bar tab 12.

The bus bar tab connector in accordance with the present invention is assembled as follows. After a Belleville washer or other spring element 32 is mounted on dowel 30, tab 12 from bus bar 14 is inserted into opening 20 of housing 18 and notches 40, 42 are mated to protrusions 36 and 38, respectively. Next, connecting tab 16 is inserted into opening 20 along interior walls 26 and 28. During this action, connecting tab 16 will contact bus bar tab 12 and force bus bar tab 12 downwardly against Belleville washer 32. As a result, Belleville washer 32 will exert a compression force upwardly against tab 12 and similarly against connecting tab 16 and upper surface 22 of opening 20. As a consequence, a strong electrical connection will be effected between tabs 12 and 16. This electrical connection is easily removed by sliding tabs 16 outwardly from housing 12.

As mentioned, spring washer 32 is an annular concave disc made from a suitable springy metal such as steel.

The second embodiment of the present invention is shown in FIGS. 11–16. Referring to FIGS. 11–16, this alternate bus bar tab connector embodiment is shown generally at 50. Alternate bus bar connector 50 varies from bus bar connector 10 (the preferred embodiment) in that it uses a camshaft 52 to hold tabs 12' and 16' together rather than a spring element or compression plate.

Bus bar connector 50 includes a camshaft 52, a lip block 54, a lip block 56, camshaft support blocks **58*a* and 58*b*, a support cap 60, and a cam engagement block 62. Cam engagement block 62 is L-shaped with a cylindrical bore 64 extending through a base 66 along the length of block 62. Bore 64 does not define a complete cylinder but rather has a small arc 69 removed therefrom so that bore 62 communicates with a rectangular annulus 70**.

Cam shaft 52 supports blocks **58*a* and 58*b* and is attached to the top and bottom of the L-shaped cam engagement block 62. Support blocks 58*a* and 58*b* are rectangular in shape and each has a cylindrical opening 72 which aligns with bore 64 of cam engagement block 62. Support blocks 58*a* and 58*b* are attached by a plurality of mechanical fasteners 63** which can include screws or the like.

Cam shaft 52 passes through cylindrical openings 72 of support blocks **58*a* and 58*b* and bore 64 of cam engagement block 62. Cam shaft 52 is seated in bore 64 wherein a cam 74 (see FIG. 15) on camshaft 52 rotates within the section of bore 64 corresponding to arc 69. Camshaft 52 also has a length which is longer than the combined length of bore 64 and openings 72. This enables a protrusion 76, which is integral with camshaft 52, to extend beyond support block 58*a*. Camshaft is held in place by a locking ring 78**.

A support cap 60 is mounted on support blocks **58*a* and 58*b* by a plurality of mechanical fasteners 80. Support cap 60 is rectangular in shape and has a size which, when assembled with support blocks 58*a* and 58*b* and cam engagement block 62**, form what is essentially a rectangular box.

Cap 60 rests on support blocks **58*a* and 58*b* in a manner which defines rectangular annulus 70 (between walls 84 and 86). On either end of annulus 70 are lip blocks 54 and 56. Lip block 54 is fastened to cam engagement block 62 by a plurality of mechanical fasteners 90. Both lip blocks 54 and 56 are generally rectangular in shape, and each has a lip 92 which extends upwardly toward rectangular annulus 70**.

Upon complete assembly of bus bar connector 50, camshaft 52 will be rotatably mounted. Rotation of camshaft 52 allows cam 74 to be positioned in rectangular annulus 70 through arc 69. When cam 74 is in this position, the height between cam 74 and wall 84 is less than the combined thickness of both tabs 34' and 35'. When camshaft 52 is rotated and cam 74 is positioned within bore 64, the difference in height between camshaft 52 and wall 84 is greater than the combined thickness of both tabs 12' and 16'. During operation, when cam 74 is internally located within bore 64 and the height between camshaft 52 and wall 84 is greater than the thickness of tabs 12' and 16', the tabs are inserted into opposite ends of rectangular annulus 70 until stopped by lips 92. At this point, camshaft 52 is rotated until cam 74 reaches the location in which it exerts force on tabs 12' and 16'. It will be appreciated that the pressure exerted by cam 74 on tabs 12' and 16' is great enough to hold tabs within connector 50 and effect electrical connection. To remove tabs 12' and 16', camshaft 52 is rotated to a point in which cam 74 is fully within bore 64 and the tabs are easily removed.

While preferred embodiment have been shown and described, various modifications and substitutions may be made thereto without departing from the spirit and scope of the invention. Accordingly, it is to be understood that the present invention has been described by way of illustration and not limitation.

What is claimed is:

1. A bus bar connector for electrically connecting a first flat conductive tab to a second flat conductive tab, comprising:

insulative housing means, said housing means having a first inner surface and an opposite second inner surface, for slidably receiving said flat tabs in overlapping contact with each other between the first and second inner surfaces; and conical disc spring means, disposed on said first inner surface, for compressing overlapping first and second tabs between the spring means and the second inner surface to electrically connect the overlapping tabs.

2. The connector of claim 1, wherein the insulative housing means comprises a one piece body extending longitudinally from a first open end to a second open end and wherein the first inner surface, second inner surface and a pair of opposed peripheral inner surfaces define a rectilinear opening extending through the body from the first open end to the second open end.

3. The connector of claim 1, further comprising a pair of shoulders extending along the first surface on opposite sides of said spring means to define first and second tab receiving slots within the rectilinear opening, said first slot being defined by the first inner surface and said shoulder and said second slot being defined by said second inner surface and said periperal inner surfaces.

4. A bus bar connector for electrically connecting a first flat conductive tab to a second flat conductive tab, comprising:

insulative housing means, said housing means having a longitudinally extending passage therethrough defined by a first inner surface and an opposite second inner surface, for slidably receiving said flat conductive tabs in overlapping contact with each other; and cam means, operatively associated with said first inner surface, for compressing overlapping first and second tabs between the cam means and the second inner surface, said cam means comprising: a bore extending through the housing means and communicating with said passage and a camshaft rotatably mounted within the bore.

5. The connector of claim 4, wherein the housing means comprising:

a cam block defining the bore and the first inner surface of the housing means;

a pair of support blocks, each support block extending from a first end to a second end, said first ends being disposed on opposite sides of the cam block and defining a pair of opposed peripheral inner surfaces of the housing means; and a cap extending across the second ends of the support blocks and defining the second inner surface of the housing means.

6. The connector means of claim 5, further comprising limit means for limiting movement of the tabs along the longitudinal axis of the passage.

* * * * *